United States Patent [19]

Prada

[11] 4,285,212

[45] Aug. 25, 1981

[54] ICE DISPENSER STORAGE ASSEMBLY

[75] Inventor: Luis E. Prada, Louisville, Ky.

[73] Assignee: General Electric Company, Louisville, Ky.

[21] Appl. No.: 155,344

[22] Filed: Jun. 2, 1980

[51] Int. Cl.[3] ..... F25C 5/18

[52] U.S. Cl. ..... 62/344; 141/358; 312/236; 312/301

[58] Field of Search ..... 62/344; 141/358, 360–362, 141/109; 312/301, 236

[56] References Cited

U.S. PATENT DOCUMENTS

| | | | |
|---|---|---|---|
| 3,108,455 | 10/1963 | Hanson | 312/301 X |
| 3,266,858 | 8/1966 | Klotz | 312/301 X |
| 3,399,994 | 9/1967 | Reddig et al. | 312/301 |
| 3,744,270 | 7/1973 | Wilcox | 62/344 |
| 3,911,692 | 10/1975 | Maxwell et al. | 62/137 |
| 4,100,761 | 7/1978 | Linstromberg et al. | 62/137 |
| 4,166,487 | 9/1979 | Spies | 141/358 |

*Primary Examiner*—William E. Tapolcai, Jr.
*Attorney, Agent, or Firm*—Frederick P. Weidner; Radford M. Reams

[57] ABSTRACT

An ice dispenser storage assembly for use in a freezer compartment of a refrigerator including a motor-driven ice dispenser. There is provided a cover secured to the inside of the freezer compartment and an ice storage receptacle movable from a first ice storage position to a second ice transfer position along and below the cover. Provision is made to stop the ice storage receptacle in the second ice transfer position and provision to energize the ice dispenser when the ice storage receptacle is in the second position and deenergize the ice dispenser when the ice storage is not in the second position.

7 Claims, 4 Drawing Figures

ICE DISPENSER STORAGE ASSEMBLY

BACKGROUND OF THE INVENTION

This invention relates to an automatic ice making and dispensing service for a conventional household refrigerator.

Many household refrigerators feature automatic ice making apparatus including a collecting or storage bin in which the ice pieces are stored at below freezing temperatures for removal by the user. Various ice makers previously used or proposed have also included means for dispensing ice pieces individually or in batches of two or three pieces. The present invention relates to providing additional ice piece storage means in conjunction with and to supplement the ice piece storage capability of a motor-driven ice dispenser such as disclosed in U.S. Pat. No. 3,422,994 and 3,640,088, both of which are assigned to the same assignee as the present invention.

SUMMARY OF THE INVENTION

According to one aspect of my invention, there is provided an ice dispenser storage assembly for use in a freezer compartment of a refrigerator including a motor-driven ice dispenser. The storage assembly includes a cover secured to the inside of the freezer compartment of the refrigerator. There is an ice storage receptacle movable from a first ice storage position to a second ice transfer position along and below the cover. Means are provided to stop the ice storage receptacle in the second ice transfer position and further means to energize the ice dispenser when the ice storage receptacle is in the second ice transfer position and deenergize the ice dispenser when the ice storage receptacle is not in the second ice transfer position. By this arrangement the ice pieces being dispensed from the motor-driven ice dispenser fall into the storage assembly until a sufficient amount of ice pieces have been received in the receptacle and the receptacle is moved from the second ice transfer position and the motor-driven ice dispenser is deenergized.

DESCRIPTION OF THE PREFERRED EMBODIMENT

Figures 1, 3:
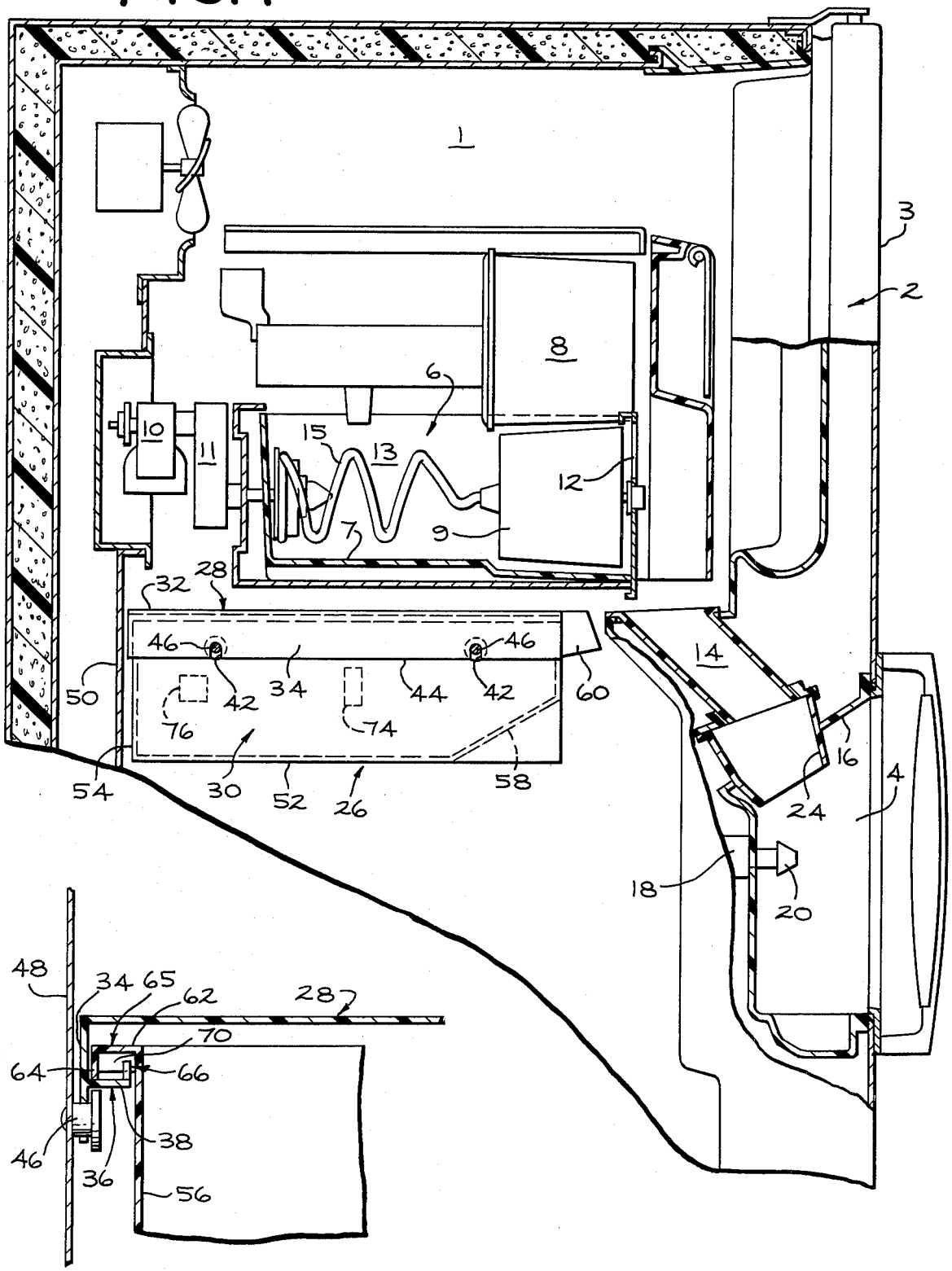
FIG. 1 is a vertical sectional view of a portion of the freezer compartment of a household refrigerator including the ice dispenser storage assembly shown in its ice storage position.
FIG. 3 is a view taken along lines 3—3 of FIG. 2.

While the exterior ice service of the present invention may be provided in any refrigerator, including a freezer compartment and a door for closing the access opening to that compartment, it will be particularly described in its application to a cabinet containing, in side-by-side relationship, a freezer compartment and a fresh food compartment. More specifically, in the accompanying drawing, there is illustrated a refrigerator including a freezer compartment 1 extending substantially the full height of the cabinet and having an access opening at the front thereof closed by a door 2. The door includes an outer panel 3 forming the outer surface or face of the door and provided with a recess 4 generally defining a service center or area to which ice is delivered exteriorly of the cabinet from an ice dispenser 6 disposed in the upper portion of the freezer compartment, that is, above the level of the recess 4.

The ice dispenser 6, briefly described, includes a receptacle 7 for receiving and storing ice pieces produced by an ice maker 8. The receptacle 7 contains dispensing means generally indicated by the numeral 13 driven by a motor 10 through a speed reduction drive means 11. The dispensing means extends lengthwise of the receptacle 7 and includes a feed section 9 at the front end thereof and a conveyor section 15 in the form of a spiral interconnecting the feed section 9 and the drive means 11. On rotation of the dispensing means, ice pieces stored in the receptacle are advanced by the conveyor section 15 to the feed section 9 for discharge through an opening 12 in the front wall of the feed section 9. Such an ice dispenser is described in U.S. Pat. No. 3,422,994, however, other types of ice dispensers may be used in connection with this invention.

A passage 14 extending from below the opening 12 of the ice dispenser through the top wall 16 of the service area access 4 is provided for conveying ice pieces discharged by the dispenser 6 to the service area.

The ice dispenser motor 10 is energized by actuation of a switch 18 as by a pushrod 20 which is accessible to the refrigerator user in the recess 4. Upon pushing pushrod 20, switch 18 actuates motor 10 which in turn, through speed reduction drive means 11, causes the conveyor upon section 15 to transport ice pieces from the rear of the receptacle 7 to the feed section 9 and through opening 12 whereupon they fall downwardly into passage 14 and are delivered through a funnel-shaped portion 24 of the passage 21 into the recess 4.

While the ice piece storage capacity of the receptacle 7 is adequate under normal refrigerator usage, there are occasions when it is desirable to have extra or supplemental storage capability in anticipation of peak usage demands. For this purpose, there will now be described my ice dispenser storage assembly that provides extra ice piece storage capacity. With reference to FIG. 1, the ice dispenser storage assembly 26 includes a cover 28 and an ice storage receptacle 30 underlying the cover. The cover includes a top wall 32 which in a side-by-side refrigerator would extend nearly the width of the freezer compartment 1. The cover 28 includes a downwardly depending flange 34. On each side of the top wall 32, a track 36 is provided as shown in FIG. 3 by a horizontal inwardly directed portion 38 depending from flange 34. The flanges 34 have notches 42 at the lower edge 44 of the flange below the tracks 36 and these notches are received in fastening elements 46 which are suitably secured to the side walls 48 of the freezer compartment 1. As can be seen in FIG. 1, the cover 28 is located immediately below the ice dispenser 6 and extends from rear wall 50 of the freezer compartment up to the passage 14 but does not interfere with the passage 14.

The storage receptacle 30 includes a bottom wall 52, a rear wall 54, side walls 56 and a front wall 58 that has a portion that slopes downwardly toward the rear of the ice storage receptacle. The front wall 58 also includes a handle portion 60 at the top thereof for gripping and moving the receptacle. The top of the side walls 56 of the receptacle, as shown in FIG. 3, have outwardly depending horizontal flanges 62 and terminal ends 64 downwardly dependent therefrom so that the side wall 56, the flange 62 and the terminal end 64 are u-shaped in cross-section and form rails 65 which cooperate with the tracks 36 of the cover 28. By this arrangement, the ice storage receptacle 30 may be moved from a first ice storage position as shown in FIG. 1 to a second ice transfer position, shown in FIG. 2, by the user merely gripping the handle portion 60 and sliding the receptacle on its rails 65 along the tracks 36 of the cover 28.

Figure 2:
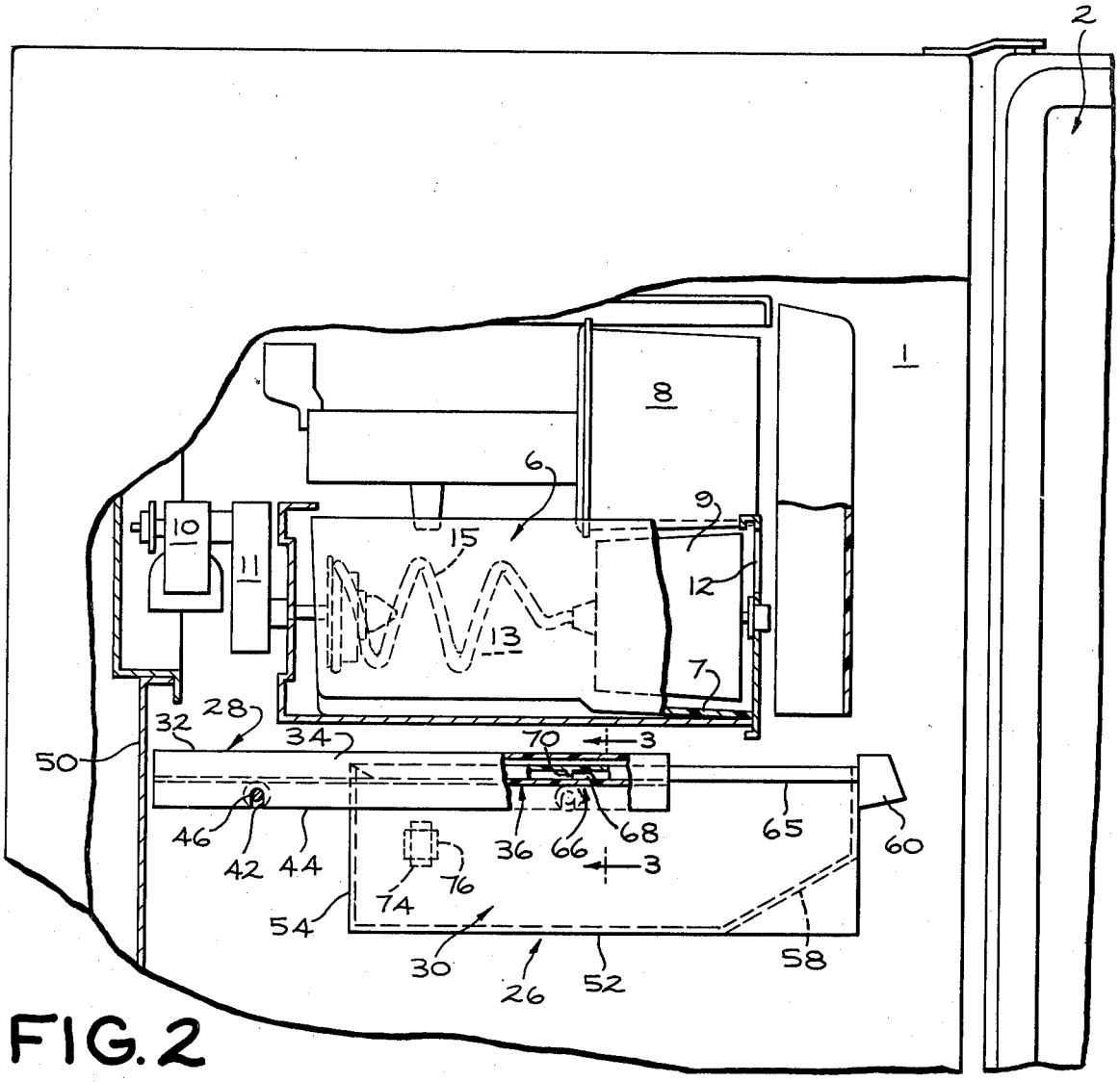
FIG. 2 is a side elevational view of a freezer compartment of a household refrigerator with parts broken away including the ice dispenser storage assembly shown in ice transfer position.

There are stop means 66 including a stop element 68 which is secured to the track 36 that is abutted by a downwardly depending member 70 attached to the rails 65 of the receptacle 30 within the u-shaped upper portion thereof. Upon abutment of the rail member 70, with the stop element 68, forward movement of the receptacle 30 is prevented and the receptacle 30 is in its second ice transfer position as shown in FIG. 2. If, however, the user wishes to remove the receptacle 30 from within the freezer compartment 1, the user merely lifts up on the receptacle disengaging the member 70 from the stop element 68 and continues forward movement of the receptacle slide it out from under the cover 28. This is often desirable if the user wishes to clean out the receptacle 30 or perhaps remove it to another location for ice piece usage.

In operation, the ice dispenser storage assembly 26 is in its first ice storage position as shown in FIG. 1 and the through-the-freezer-door ice service may be initiated as is normally the case by the user pushing pushrod 20 to actuate switch 18 which, in turn, energizes drive motor 10 and through speed reduction drive means 11, causes the conveyor portion 15 to be rotated and ice pieces moved through the feed section 9 out through the opening 12 in the front wall thereof. The ice pieces fall downwardly into passage 14 and portion 24 to the recess 4 without the need of opening the freezer door 2. When extra ice piece storage is desired the freezer door 2 is opened and the user moves the ice storage receptacle 30 from the first ice storage position shown in FIG. 1, to the second ice transfer position shown in FIG. 2, by moving the receptacle on its rails 65 along tracks 36 until abutment of member 70 and stop element 68 whereupon forward movement of the receptacle is stopped. It will be noted in FIG. 2 that in this position, the open ice piece storage receptacle 30 is in position below the opening 12 and replaces the passage 14 so that ice pieces being delivered from the ice dispenser will fall directly into the ice storage receptacle 30. By the front wall 58 being sloped downwardly toward the rear of the receptacle, the ice pieces are distributed toward the rear of the receptacle.

When the ice piece storage receptacle 30 is in the second ice piece transfer position as shown in FIG. 2, means are provided to energize the ice dispenser. In the preferred embodiment, this means is a reed switch 74 which is located on the side wall of the freezer compartment 1. To actuate the reed switch 74 when the ice storage receptacle 30 is in the ice transfer position, there is a permanent magnet 76 secured to the side wall 56 of the ice storage receptacle 30 and is located such that when the receptacle 30 is in the second ice transfer position, the permanent magnet will be in register with the reed switch. The magnetic force of the permanent magnet will actuate the reed switch which in turn through electrical connections will energize the drive motor 10 of the dispenser. In this manner, the user may continue to have ice pieces dispensed into the receptacle 30 until the desired amount has been dispensed and then the user moves the ice storage receptacle 30 from the second ice transfer position thus taking permanent magnet 76 out of registry with reed switch 74 and the drive motor 10 is deenergized. The receptacle may be moved to its first ice storage position as shown in FIG. 1 or removed from the freezer compartment 1. If desired, the switch means for energizing and deenergizing the drive motor 10 may be a manual switch operated by the user or it may be any other type of switch arrangement whereby the drive motor 10 will be energized when the ice storage receptacle 30 is in the second ice transfer position and deenergized when the ice storage receptacle 30 is not in the second ice transfer position.

Figure 4:
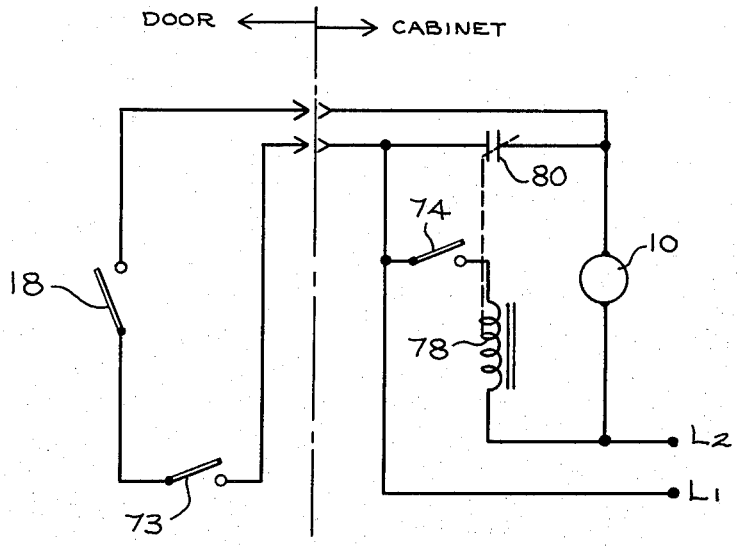
FIG. 4 is a schematic wiring diagram of the electrical interlock for the ice dispenser storage assembly.

FIG. 4 is a wiring diagram that describes the electrical interlock described above. As can be seen in FIG. 4, switch 18 that would normally actuate the drive motor 10 when through-the-door ice service is desired, is disabled by opening the freezer door 2. Switch 73 is the freezer door interlock that prevents the dispensing of ice pieces when the freezer door is open. When the ice storage receptacle 30 is moved to the second ice transfer position as shown in FIG. 2, switch 74 is closed by means of permanent magnet 76 and relay coil 78 is energized thus closing normally open contacts of switch 80 to provide power to the motor 10 to energize it and cause the dispensing of ice pieces. It will be understood that lines L1 and L2 go to the electrical supply being furnished to the refrigerator. When the ice storage receptacle 30 is moved from its second ice piece transfer position, the switch 74 is opened deenergizing the relay coil 78 and causing contacts of 80 to open whereupon the drive motor 10 is deenergized and the dispensing of ice pieces is stopped.

The foregoing is a description of the preferred embodiment of the invention and it should be understood that variations may be made thereto without departing from the true spirit of the invention, as defined in the appended claims.

What is claimed is:

1. An ice dispenser storage assembly for use in a freezer compartment of a refrigerator including a motor-driven ice dispenser comprising;

a cover secured to the inside of the freezer compartment, an ice storage receptacle movable from a first ice storage position to a second ice transfer position along and below the cover, means to stop the ice storage receptacle in the second ice transfer position, and means to energize the ice dispenser when the ice storage receptacle is in the second position and deenergize the ice dispenser when the ice storage receptacle is not in the second position.

2. The ice dispenser storage assembly of claim 1 wherein the cover has a downwardly depending flange in the form of a track on each side thereof and the ice storage receptacle cooperates with the tracks for movement between the first and second positions.

3. The ice dispenser storage assembly of claim 2 wherein the ice storage receptacle has rails at the top thereof which cooperate with the tracks of the cover for movement between the first and second positions.

4. The ice dispenser storage assembly of claim 1 wherein the ice storage receptacle is removable from the freezer compartment.

5. The ice dispenser storage assembly of claim 1 wherein the ice storage receptacle has a front wall that slopes downwardly toward the rear of the ice storage receptacle.

6. The ice dispenser storage assembly of claim 1 wherein the means to energize the ice dispenser is a switch in the sidewall of the freezer actuated by means on the ice storage receptacle when the ice storage receptacle is in the second position.

7. The ice dispenser storage assembly of claim 6 wherein the switch is a reed switch and the means for actuation thereof on the ice storage receptacle is a permanent magnet.

* * * * *